US007908726B2

(12) United States Patent
Castle et al.

(10) Patent No.: US 7,908,726 B2
(45) Date of Patent: Mar. 22, 2011

(54) WRENCH FOR TAMPER SWITCH INSTALLATION

(75) Inventors: Scott T Castle, Canandaigua, NY (US); Paul DeLozier, Walworth, NY (US); Dennis M Caler, Marion, NY (US); Dennis Petricoin, Hemlock, NY (US)

(73) Assignee: Robert Bosch GmbH, Stuttgart (DE)

( * ) Notice: Subject to any disclaimer, the term of this patent is extended or adjusted under 35 U.S.C. 154(b) by 1403 days.

(21) Appl. No.: 11/259,808

(22) Filed: Oct. 27, 2005

(65) Prior Publication Data

US 2007/0095172 A1 May 3, 2007

(51) Int. Cl.
*B25B 27/26* (2006.01)

(52) U.S. Cl. ..... 29/281.1; 29/272; 29/257

(58) Field of Classification Search ..... 29/281.1, 29/257, 252, 256, 267, 272; 81/52, 462
See application file for complete search history.

(56) References Cited

U.S. PATENT DOCUMENTS

| | | | | |
|---|---|---|---|---|
| 4,234,879 | A | 11/1980 | Baker | |
| 4,331,945 | A | 5/1982 | Cattani, II | |
| 4,599,498 | A | 7/1986 | Shimoya et al. | |
| 4,751,493 | A | 6/1988 | Miller | |
| 4,982,627 | A * | 1/1991 | Johnson | 81/121.1 |
| 5,782,148 | A * | 7/1998 | Kerkhoven | 81/124.6 |
| 5,974,916 | A * | 11/1999 | Lassiter | 81/121.1 |
| 5,996,448 | A * | 12/1999 | Suekage | 81/177.2 |
| 6,807,884 | B2 * | 10/2004 | Sillman | 81/462 |
| 2004/0060400 | A1 * | 4/2004 | Sillman | 81/462 |
| 2004/0103763 | A1 * | 6/2004 | Shyu | 81/63.1 |
| 2004/0144942 | A1 | 7/2004 | Royse | |
| 2007/0095172 | A1 * | 5/2007 | Castle et al. | 81/52 |

FOREIGN PATENT DOCUMENTS

| | | |
|---|---|---|
| DE | 299 12 565 | 11/1999 |
| EP | 1 332 837 | 8/2003 |
| GB | 2 185 199 | 7/1987 |

OTHER PUBLICATIONS

Search Report for EP Application No. 06 021 385.7-2316 issued by the European Patent Office on Nov. 22, 2007.

* cited by examiner

*Primary Examiner* — Lee D Wilson
(74) *Attorney, Agent, or Firm* — Baker & Daniels LLP

(57) ABSTRACT

A wrench for tamper switch installation for use with a tamper switch arrangement including an enclosure containing a tamper switch assembly having a mounting rail for assembling the tamper switch assembly to a security system enclosure. The wrench may be capable of holding two separate nuts and have cooperating mating structure to slidably mate with the mounting rail of the tamper switch arrangement. The nuts may be frictionally-fitted into the wrench, after which the wrench is slidably moved onto the mounting rail until the nuts line up with two throughbores in the mounting rail. Two screws or bolts are then inserted through a surface of the security system enclosure and traverse the throughbores in the mounting rail. The screws or bolts then threadably engage the two nuts disposed within the wrench and are threaded therethrough via rotation with a suitable instrument, e.g., a screwdriver, located outside of the security system enclosure. The wrench prevents the two nuts from turning while an installer installs the two screws or bolts from outside the security system enclosure.

16 Claims, 2 Drawing Sheets

WRENCH FOR TAMPER SWITCH INSTALLATION

BACKGROUND OF THE INVENTION

1. Field of the Invention

The present invention relates to a wrench for installing systems for detecting unauthorized tampering with a device, and, more particularly, to wrenches used for installing systems for detecting unauthorized tampering with a device that is disposed within an enclosure.

2. Description of the Related Art

Many devices must be placed in locations where they may be exposed to unauthorized tampering or theft. Such devices include controllers for telephone systems, alarm systems, cable television systems, firearms, art work and other valuables, for example. In order to protect the devices from tampering and other forms of physical harm, they may be placed within security system enclosures in the form of boxes that are attached to fixed structures such as ceilings, walls, floors and posts. The boxes may have hinged covers for enabling authorized access to the devices within the boxes, and these doors may be locked shut.

The security system enclosures commonly employ tamper switches for detecting that the cover of the enclosure has been opened, or that the enclosure has been removed from the fixed structure to which it was attached. A typical tamper switch has a pair of contacts that may be opened or closed as a result of the enclosure door being opened, or as a result of the enclosure being removed from the fixed structure. A problem, however, is that separate switches must be used for detecting the opening of the door and the removal of the enclosure from the fixed structure. That is, one tamper switch may detect the opening of the door, and a separate tamper switch may be required to detect the removal of the enclosure from the wall. The use of two separate switches adds to the cost and increases the size of the tamper detection system.

An exemplary tamper switch arrangement that utilizes a single tamper switch to detect both the opening of a door of the security system enclosure and the removal of the enclosure from the fixed structure on which it is mounted is fully disclosed and described in U.S. patent application Ser. No. 11/065,191, filed Feb. 24, 2005, entitled TAMPER SWITCH ARRANGEMENT, the disclosure of which is hereby expressly incorporated herein by reference. During installation of the tamper switch arrangement, the mounting rail of the tamper switch must be secured to an inner surface of the security system enclosure. Generally, two screws or bolts may be used which are inserted through the surface of the enclosure and through two throughbores in the mounting rail, after which two nuts are threaded onto the screws or bolts to secure the mounting rail of the tamper switch to the surface of the security system enclosure. However, installers typically have difficulty in securely holding the two nuts and preventing them from turning while installing the two screws or bolts from outside the enclosure that hold the mounting rail of the tamper switch in place. Such difficulty occasionally arises because an installer must situate a wrench at a distance spaced apart from the cover of the security system enclosure and/or must work in a confined space within the enclosure. Once the mounting rail is installed, then the tamper switch is installed on the mounting rail.

What is needed in the art is a wrench for tamper switch mounting rail installation that prevents the securing nuts from turning while installing the two screws or bolts to secure the mounting rail to the security system enclosure.

SUMMARY OF THE INVENTION

The present invention provides a wrench for tamper switch installation for use with a tamper switch arrangement including an enclosure containing a tamper switch assembly having a mounting rail for assembling the tamper switch assembly to a security system enclosure. The wrench may be capable of holding two separate nuts and have cooperating mating structure to slidably mate with the mounting rail of the tamper switch arrangement. The nuts may be frictionally-fitted into the wrench, after which the wrench is slidably moved onto the mounting rail until the nuts line up with two throughbores in the mounting rail. Two screws or bolts are then inserted through a surface of the security system enclosure and traverse the throughbores in the mounting rail. The screws or bolts then threadably engage the two nuts disposed within the wrench and are threaded therethrough via rotation with a suitable instrument or tool, e.g., a screwdriver, located outside of the security system enclosure. The wrench prevents the two nuts from turning while an installer installs the two screws or bolts from outside the security system enclosure.

The invention comprises, in one form thereof, in combination, a system including a wrench for installing a rail in a security system enclosure with at least one securing element and at least one securable element including a wrench having a body portion; the body portion including at least one recess at a first end thereof, the at least one recess shaped to mate with the at least one securing element in a friction-fit engagement; and the body portion including rail mounting engagement structure; a security system enclosure having an inner surface and at least one aperture disposed in the inner surface to accept passage of the at least one securable element; and a rail including at least one throughbore and disposed on the inner surface of the enclosure, the at least one throughbore alignable with the at least one aperture disposed in the inner surface of the enclosure.

In another form, the invention comprises a wrench for installing a rail in a security system enclosure with at least one securing element, the rail including at least one throughbore and disposed on an inner surface of the enclosure, the enclosure including at least one aperture in the inner surface to accept passage of at least one securable element and alignable with the at least one throughbore, including a body portion; the body portion including at least one recess at a first end thereof, the at least one recess shaped to mate with the at least one securing element in a friction-fit engagement; and the body portion including a rail mounting engagement structure.

In yet another form, the invention comprises a method for installing a rail in a security system enclosure using a wrench, the wrench including at least one recess, the rail having at least one throughbore and disposed on an inner surface of the enclosure, the rail being securable to the enclosure with at least one securing element, the at least one recess shaped to mate with the at least one securing element, the enclosure including at least one aperture in the inner surface for accepting passage of at least one securable element therethrough, including the steps of placing the rail on the inner surface of the enclosure such that the at least one aperture in the inner surface of the enclosure is aligned with the at least one throughbore in the rail; placing the at least one securing element in the at least one recess of the wrench; sliding the wrench along the rail; aligning the at least one securing element with the at least one throughbore in the rail; inserting the at least one securable element through the at least one aperture and the at least one throughbore; engaging the at least one securable element with the at least one securing element; and removing the wrench from the rail.

An advantage of the present invention is that the wrench prevents the two nuts from turning while installing the two screws that hold the mounting rail of the tamper switch arrangement in place on a surface of the security system enclosure.

Another advantage is that an installer cannot accidentally leave the wrench on the mounting rail after installation because the wrench must be removed from the mounting rail prior to installing the tamper switch on the mounting rail. This requirement removes the possibility of detaching the mounting rail from outside the security system enclosure.

Another advantage is that the wrench eliminates the need for an installer to bring a separate wrench to the installation site.

Yet another advantage is that the wrench is sized to be inserted into a security system enclosure and is capable of securely holding two nuts at a location spaced from the cover of the enclosure.

Another advantage is that the wrench eliminates the need for an installer to tighten the nuts in a confined space defined by the security system enclosure.

Still another advantage is that the wrench of the present invention may be disposable after use.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
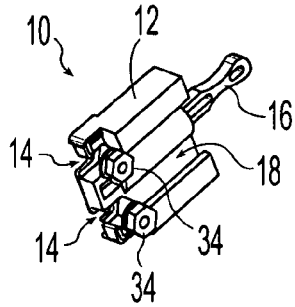
FIG. 1 is a perspective view of a wrench according to the present invention.

Corresponding reference characters indicate corresponding parts throughout the several views. Although the exemplifications set out herein illustrate the invention, in one form, the embodiments disclosed below are not intended to be exhaustive or to be construed as limiting the scope of the invention to the precise form disclosed.

DESCRIPTION OF THE PRESENT INVENTION

Figure 2:
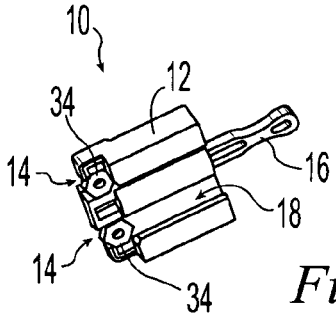
FIG. 2 is a perspective view of the wrench of FIG. 1, further illustrating two nuts secured therein.
Figure 3:
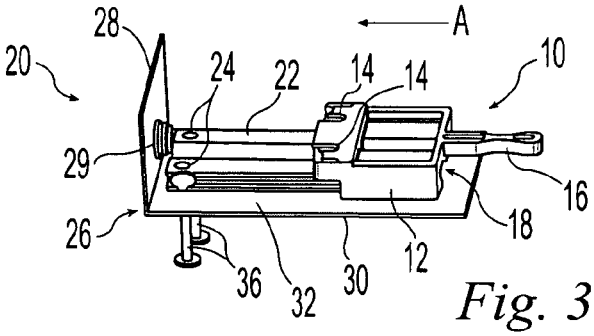
FIG. 3 is a perspective view of a portion of a tamper switch arrangement including a mounting rail, and further illustrating the wrench of FIG. 2 slidably disposed on the rail.
Figure 4:
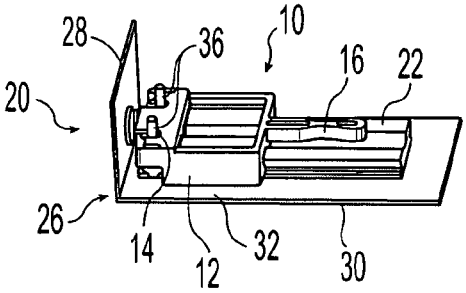
FIG. 4 is a perspective view of the tamper switch arrangement of FIG. 3, further illustrating the wrench of FIG. 2 completely slid onto the rail and two screws or bolts engaged with the two nuts.
Figure 5:
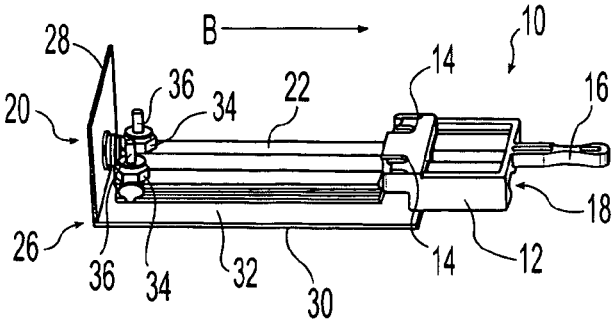
FIG. 5 is a perspective partial view of the tamper switch arrangement of FIG. 3, further illustrating the nuts secured to the screws or bolts and the wrench completely removed from slidable engagement with the rail.

Referring now to the drawings, and particularly to FIG. 1, there is shown wrench 10 including body portion 12 and handle 16 disposed at one end thereof. Body portion 12 includes at least one recess 14 and channel or groove 18. Channel 18 is sized and shaped to substantially match the size and shape of rail 22 (FIGS. 3-5). Recesses 14 are sized for frictional-fit engagement with hexagonal shaped nuts 34 (FIG. 2). Recesses 14 may include any polygonal shape, such as a rectangular shape or a hexagonal shape, such as to mate with the shape of nuts 34. Nuts 34 may also be in a polygonal shape, such as a square, rectangle, or hexagonal shape. Nuts 34 are sized slightly smaller than the opening of recesses 14 such that the friction-fit between recesses 14 and nuts 34 holds nuts 34 in place within wrench 10, shown in FIG. 2, prior to engagement with screws or bolts 36 in tamper switch arrangement 20 (FIGS. 3-5).

Referring now to FIGS. 3-5, tamper switch arrangement 20 includes enclosure 26 and rail 22. In FIGS. 3-5, enclosure 26 is only partially shown and includes end wall 28 configured to substantially match a wall surface to which tamper switch arrangement 20 may be mounted and wall 30 including inner surface 32. Although described throughout with end wall 28 configured to be attached to a wall and rail 22 attached to a bottom wall of enclosure 26, rail 22 may be attached to any wall of enclosure 26 depending on what enclosure 26 is mounted to, e.g., a wall, a ceiling, or a floor surface. End wall 28 also includes an optional plug 29 which may be used for installing enclosure 26 to a wall. Inner surface 32 of wall 30 of enclosure 26 includes two apertures 33 (FIG. 6) which align with throughbores 24 (FIG. 3) in rail 22. Rail 22 is disposed on inner surface 32 of enclosure 26. Apertures 33 in wall 30 of enclosure 26 and throughbores 24 in rail 22 are sized to accept two screws or bolts 36 which extend therethrough.

In operation, wrench 10 is slidably engaged with rail 22 via the engagement of rail 22 with channel or groove 18, as shown in FIG. 3. Wrench 10 is moved in the direction of Arrow A prior to inserting screws 36 through apertures 33 in wall 30 and throughbores 24. Wrench 10 is slid along rail 22 until the apertures in nuts 34 align with throughbores 24 of rail 22 and apertures 33 in wall 30 of enclosure 26. Screws 36 are then inserted through apertures 33 in wall 30 and through throughbores 24 of rails 22 and threaded into nuts 34 until completely tight via an instrument, e.g., a screwdriver, located outside enclosure 26. The engagement of recesses 14 and nuts 34 in wrench 10 prevents rotational movement of nuts 34 while turning screws 36.

Once nuts 34 are completely tightened onto screws 36, thereby holding rail 22 securely to wall 30 of enclosure 26, wrench 10 may be slid off rail 22 in the general direction of Arrow B, shown in FIG. 5, thereby leaving behind nuts 34 secured to screws or bolts 36. Advantageously, an installer cannot accidentally leave wrench 10 on rail 22 after installation of rail 22 to enclosure 26 because the tamper switch to be installed on rail 22 occupies the same location as wrench 10. The tamper switch to be installed on rail 22 is fully disclosed and described in U.S. patent application Ser. No. 11/065,191, filed Feb. 24, 2005, entitled TAMPER SWITCH ARRANGEMENT, the disclosure of which is hereby expressly incorporated herein by reference. Wrench 10 must be removed from rail 22 prior to installing the tamper switch. Such requirement removes the possibility of detaching rail 22 from outside enclosure 26.

Advantageously, wrench 10 eliminates the need for a user to bring a separate wrench to the installation site of tamper switch arrangement 20 and wrench 10 may be disposable after use. Furthermore, wrench 10 prevents nuts 34 from turning while a user installs screws or bolts 36 from outside the security system enclosure 26.

Figure 6:
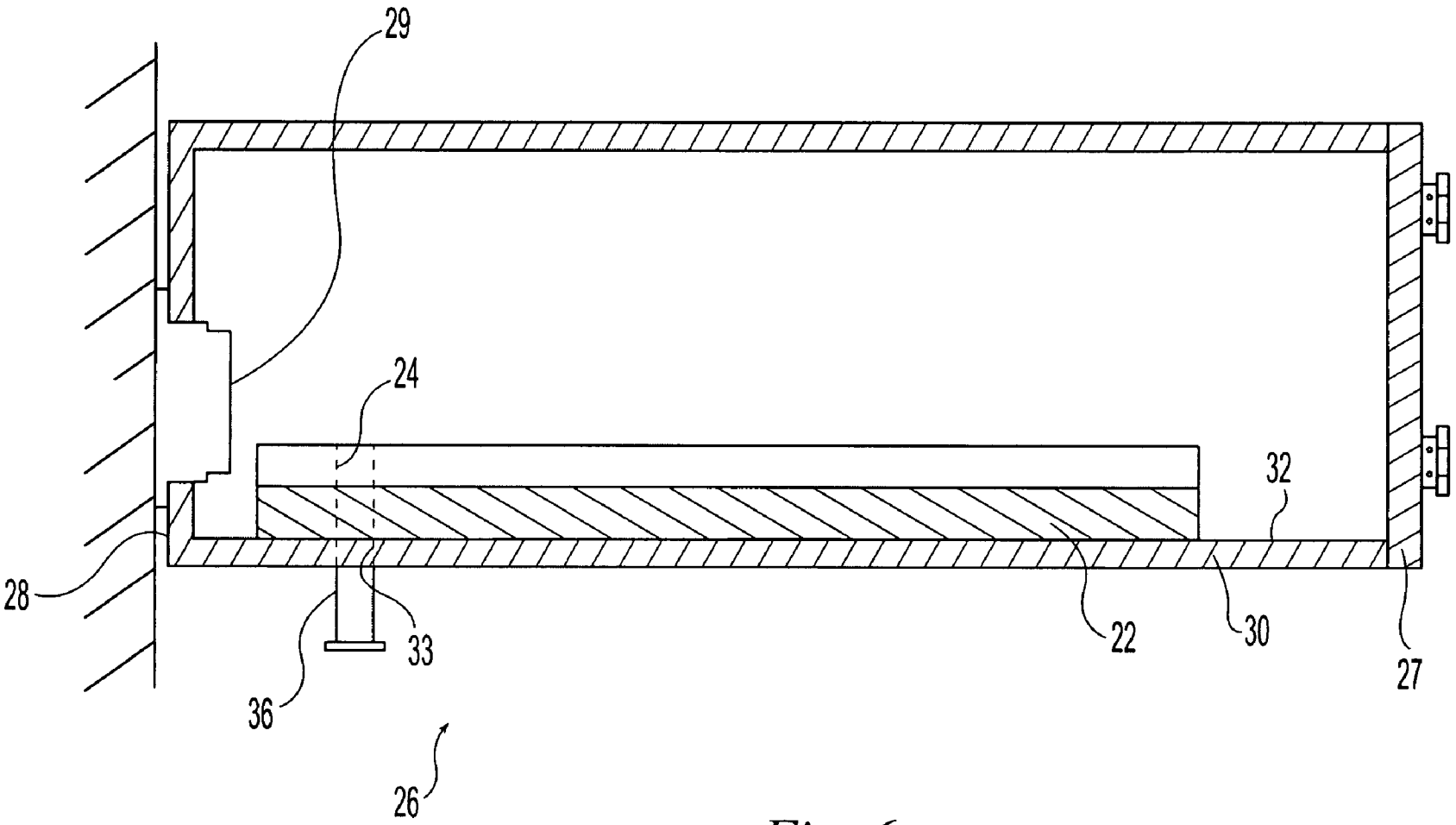
FIG. 6 is a cross-sectional view of the tamper switch arrangement of FIG. 3, further illustrating the complete security system enclosure.

As shown in FIG. 6, enclosure 26 forms a rectangular-box structure including end wall 28, wall 30, and cover 27 which may be hingedly attached to the remainder of enclosure 26.

The structure of enclosure 26 permits limited accessibility at the point at which nuts 34 need to be tightened to secure rail 22 to enclosure 26. Thus, wrench 10 is sized to slide within the box formed by enclosure 26 and advantageously allow an installer to securely hold both nuts 34 at a distance from cover 27 of enclosure 26. Thus, an installer does not have to bring a separate tool to the jobsite to secure rail 22 to enclosure 26 and the installer can efficiently tighten both nuts 34 with a screwdriver or other suitable tool or instrument from outside of enclosure 26. An installer is not required to maneuver within the small confines of the rectangular box formed by enclosure 26 to tighten nuts 34. Wrench 10 eliminates the need to place any other tools within enclosure 26, and, by securing nuts 34 to screws 36 with wrench 10, screws 36 are not removable once wrench 10 is removed from rail 22.

While this invention has been described as having an exemplary design, the present invention may be further modified within the spirit and scope of this disclosure. This application is therefore intended to cover any variations, uses, or adaptations of the invention using its general principles.

What is claimed is:

1. In combination, a system including a wrench for installing a rail in a security system enclosure with at least one securing element and at least one securable element, comprising:

a wrench, comprising:

a body portion;

said body portion including at least one recess at a first end thereof, said at least one recess shaped to mate with the at least one securing element in a friction-fit engagement; and said body portion including rail mounting engagement structure;

a security system enclosure having an inner surface and at least one aperture disposed in said inner surface to accept passage of the at least one securable element, said wrench sized to be placed within said enclosure; and a rail including at least one throughbore and disposed on said inner surface of said enclosure, said at least one throughbore alignable with the at least one aperture disposed in said inner surface of said enclosure, wherein said at least one recess is alignable with the at least one throughbore, and, upon said alignment of said at least one recess with the at least one throughbore, the at least one securing element is inserted through the at least one throughbore and engages the at least one securing element, whereby the rail is fixedly installed in the enclosure.

2. The combination of claim 1, wherein said wrench further comprises a handle connected to said body portion at a second end thereof opposite said first end.

3. The combination of claim 1, wherein the at least one securing element comprises at least one hexagonal nut.

4. The combination of claim 1, wherein said at least one recess comprises at least one hexagonal-shaped recess.

5. The combination of claim 1, wherein said at least one recess comprises at least one rectangular-shaped recess.

6. The combination of claim 1, wherein said at least one recess comprises two recesses.

7. The combination of claim 1, wherein said rail mounting engagement structure comprises a channel shaped to substantially match the shape of the rail.

8. The combination of claim 1, wherein the at least one securable element comprises at least one screw.

9. A wrench for installing a rail in a security system enclosure with at least one nut, the rail including at least one throughbore and disposed on an inner surface of the enclosure, the enclosure including at least one aperture in the inner surface to accept passage of at least one securable element and alignable with the at least one throughbore, comprising:

a body portion;

said body portion including at least one recess at a first end thereof, said at least one recess shaped to mate with the at least one nut in a friction-fit engagement to hold the at least one nut on the body portion and prevent rotation of the at least one nut relative to the body portion; and said body portion including rail mounting engagement structure, the rail mounting engagement structure including a channel shaped to substantially match the shape of the rail.

10. The wrench of claim 9, further comprising a handle connected to said body portion at a second end thereof opposite said first end.

11. The wrench of claim 9, wherein said at least one recess is alignable with the at least one throughbore, and, upon said alignment of said at least one recess with the at least one throughbore, the at least one securable element is inserted through the at least one throughbore and engages the at least one nut, whereby the rail is fixedly installed in the enclosure.

12. The wrench of claim 9, wherein the at least one nut comprises at least one hexagonal nut.

13. The wrench of claim 9, wherein said at least one recess comprises at least one hexagonal-shaped recess.

14. The wrench of claim 9, wherein said at least one recess comprises at least one rectangular-shaped recess.

15. The wrench of claim 9, wherein said at least one recess comprises two recesses.

16. The wrench of claim 9, wherein the at least one securable element comprises at least one of a screw and a bolt.

* * * * *